US008716675B2

(12) United States Patent
Chetwani et al.

(10) Patent No.: US 8,716,675 B2
(45) **Date of Patent: *May 6, 2014**

(54) METHODS AND APPARATUS FOR MASS SPECTROMETRY UTILIZING AN AC ELECTROSPRAY DEVICE

(75) Inventors: Nishant Chetwani, Mishawaka, IN (US); Catherine Cassou, Tiburon, CA (US); David Go, South Bend, IN (US); Hsueh-Chia Chang, Granger, IN (US)

(73) Assignee: University of Notre Dame du Lac, Notre Dame, IN (US)

( * ) Notice: Subject to any disclaimer, the term of this patent is extended or adjusted under 35 U.S.C. 154(b) by 136 days.

This patent is subject to a terminal disclaimer.

(21) Appl. No.: 13/095,288

(22) Filed: Apr. 27, 2011

(65) Prior Publication Data

US 2012/0199732 A1 Aug. 9, 2012

Related U.S. Application Data

(60) Provisional application No. 61/343,322, filed on Apr. 27, 2010, provisional application No. 61/460,497, filed on Jan. 3, 2011.

(51) Int. Cl.
*H01J 49/10* (2006.01)

(52) U.S. Cl.
USPC ..... 250/424; 250/423 R; 250/288

(58) Field of Classification Search
USPC ..... 250/281, 282, 288, 423 R, 424, 425, 250/423 F
See application file for complete search history.

(56) References Cited

U.S. PATENT DOCUMENTS

| | | | | |
|---|---|---|---|---|
| 5,306,910 | A | 4/1994 | Jarrell et al. | |
| 6,737,640 | B2 | 5/2004 | Kato | |
| 8,267,914 | B1 * | 9/2012 | Chang et al. | 604/500 |
| 2003/0183757 | A1 | 10/2003 | Kato | |
| 2010/0271631 | A1 * | 10/2010 | Schluter et al. | 356/315 |

FOREIGN PATENT DOCUMENTS

| | | |
|---|---|---|
| JP | 06310088 | 11/1994 |
| JP | 09180673 | 7/1997 |
| JP | 4167593 B2 | 10/2008 |

OTHER PUBLICATIONS

ISA/KR, International Search Report and Written Opinion of PCT Appln. No. US2011/034119, date of completion of ISR and Opinion Feb. 28, 2012, 10 pgs.

* cited by examiner

*Primary Examiner* — Robert Kim
*Assistant Examiner* — Hanway Chang
(74) *Attorney, Agent, or Firm* — Greenberg Traurig, LLP

(57) ABSTRACT

An alternating current electrospray mass spectrometry device includes an electrospray device having at least one emitter providing a passageway for transmission of an analyte sample. At least one conductive element is in electrical communication with the at least one emitter. A power source generates an alternating current electric field to form a liquid cone at a tip of the emitter and ionizes the analyte sample present in the liquid cone. The frequency of the electric field entrains low mobility ions in the liquid cone. The AC electric field causes the emitter to discharge the liquid cone as a liquid aerosol drop, and a mass spectrometry device analyzes the ionized analyte sample to determine the composition of the contained analyte sample.

16 Claims, 16 Drawing Sheets

| Frequency (in kHz) | $\frac{I((Pentyl)_4N^+)}{I((Butyl)_4N^+)}$ |
|---|---|
| 80 | 11.2±0.65 |
| 150 | 10.9±0.96 |
| 200 | 10.97±0.98 |
| 250 | 6.66±0.12 |
| 300 | 5.31±0.15 |
| 400 | 4.48±0.11 |

METHODS AND APPARATUS FOR MASS SPECTROMETRY UTILIZING AN AC ELECTROSPRAY DEVICE

CROSS REFERENCE TO RELATED APPLICATION

This application is a non-provisional application claiming priority from U.S. Provisional Application Ser. No. 61/343,322, filed Apr. 27, 2010, and from U.S. Provisional Application Ser. No. 61/460,497, filed Jan. 3, 2011, each of which are incorporated herein by reference in their entirety.

GOVERNMENT INTEREST STATEMENT

The United States Government has certain rights in this invention pursuant to Grant No. CBDIF07-PRO013-2-0023 with the Defense Treat Reduction Agency, and Grant No. NSF-IDBR0852741 with the National Science Foundation.

FIELD OF THE DISCLOSURE

The present disclosure relates generally to alternating current (AC) electrospray devices, and more particularly, to methods and apparatus for mass spectrometry utilizing an AC electrospray device.

BACKGROUND OF RELATED ART

The application of a direct current (DC) electric field to generate charged liquid droplets from Taylor cones in DC electrospray is widely used in pharmaceutical mass spectrometry because of its ability to produce a beam of relatively mono-dispersed and small (e.g., <100 nm) charged droplets that can contain individual protein molecules, see J. B. Fenn, M. Mann, C. K. Meng, S. F. Wong, and C. M. Whitehouse, Science 246, 64, 1989, the entire contents and disclosure of which is hereby incorporated by reference. Other areas of application include electrostatic printing, nano-particle technology, micro-encapsulation, fiber electrospinning, etc., see G. Castano, and V. Hruby, J. Fluid Mech. 459, 245, 2001, G. Loscertales, A. Barrero, I. Guerrero, R. Cortijo, M. Marquez, and A. M. Ganan-Calvo, Science 295, 1695, 2002, the entire contents and disclosures of which are hereby incorporated by reference. The DC field and interfacial charges combine to produce a Maxwell force that stretches the drop into a conic shape (known as a Taylor cone) and ejects streams of small charged droplets from the tip at large frequencies (>1 kHz).

The Taylor cone is formed due to a static balance between the azimuthal capillary stress and the Maxwell normal stress exerted by the predominantly tangential and singular electric field in the liquid. For electrolyte spraying from a DC Taylor cone, surface ions from the bulk electrolyte are transported and concentrated at the tip to drive a Rayleigh fission process. Spraying of dielectric liquid via DC Taylor cones is also possible, but it requires significantly higher voltages and is believed to be driven by the momentum and mass flux of an ion evaporation process at the cone tip, see M. Gamero-Castano and J. Fernandez de Ia Mora, J. of Mass Spectrom., 35, 790-803, 2000, the entire contents and disclosure of which is hereby incorporated by reference.

In DC electrospraying, a steady, continuous beam of sub-micron charged droplets (typically 0.2-0.3 microns) stream out in a Taylor cone. A typical image of a DC Taylor cone obtained by spraying ethanol into air using DC electric fields is shown in FIG. 1. The Taylor cone and the spray initiation for ethanol depends on several experimental conditions, but is typically observed beyond 2-3 kilovolts.

There has been little investigation into using an AC field for an electrospray. In earlier AC electrospray work it was expected that, at high frequency, the net Maxwell stress would vanish and drop ejection would be impossible. The few reported studies concentrated on low frequencies and superimposing a small AC bias onto a large DC field, see S. B. Sample, and R. Bollini, J. Colloid Interface Sci., 41, 185, 1972; and M. Sato. J. Electrostatics, 15, 237, 1984, the entire contents and disclosures of which are hereby incorporated by reference.

Both of the studies described above, however, do not report spraying dynamics that are fundamentally different from a DC electrospray. One other reported work consisted of using a high frequency AC electric field with 30 kHz and 45 kHz frequencies, see G. Gneist and H. J. Bart, Chem. Eng. Technol., 25, 129-133, 2002, the entire contents and disclosure of which is hereby incorporated by reference. However, this work involved dispersing drops into an ambient liquid medium purely with the intention of generating emulsion drops in liquid/liquid systems.

Mass spectrometry is a common chemical analysis technique used in fields such as environmental analysis, forensic chemistry, health care, and the like. Detection and identification of biomolecules such as DNA, peptides, proteins, and other molecular biomarkers, form the core of a biotechnology industry, and mass spectrometry plays a significant role in developing this sector. However, use of mass spectrometry in both research and practical fields is often limited by the ionization source, which either does not produce a sufficient number of sample ions for detection, fragments the sample ions limiting detection capability, or does not efficiently transfer the ions into the mass spectrometer.

Proteomics, the large-scale study of proteins, benefited from the disclosure of a direct current electrospray ionization (DC ESI) in the 1980s, as DC ESI is a soft ionization technique that does not fragment the charged molecules during analysis. Another soft ionization technique is Matrix Assisted Laser Desorption Ionization (MALDI) that was identified around the same time as DC ESI. Together, DC ESI and MALDI helped foster mass spectrometry as an analytical tool for the study of several classes of biomolecules.

DC ESI, however, relies on the formation of a sharp conical meniscus called a Taylor cone, by the application of a high DC voltage across a liquid source. The charged droplets that are generated from the tip of the Taylor cone undergo successive Rayleigh fission to ultimately yield a quasi-molecular ion that can be detected by mass spectrometry. One feature of DC ESI is that it can generate multiple charged states, depending upon the size of the molecule. Thus, mass spectrometers with limited mass-to-charge ratio (m/z) detection capability can be used to detect molecules with high molecular mass, such as proteins. In negative mode DC ESI (e.g. to generate anions), however, an electron discharge can form that interferes with the mass spectra and yields a mass spectrum with a low signal-to-noise (S/N) ratio, indicative of a poor sensitivity and a limit on mass spectrometer performance. Thus, the phenomenon of electron discharge limits the use of DC ESI extensively to positive mode mass spectrometry.

Unlike DC ESI that utilizes electrical energy to generate ions from a liquid sample, MALDI uses light energy (e.g., a laser beam) to generate ions from a solid sample. Although MALDI generates only monovalent or sometimes, bivalent charge states of biomolecules, MALDI is typically utilized for negative mode mass spectrometry due to the disadvantages associated with DC ESI.

There is, therefore, a need for an improved mass spectra analysis. Because high frequency AC only entrains low mobility charged species, the high mobility electrons are substantially always in equilibrium and not discharged. AC ESI, therefore, yields a better signal-to-noise ratio in the mass spectra, even in negative mode. The mechanism of the examples described herein offers a preferential entrainment of ions and further pre-concentrates the analyte ions in the liquid cone and improves the signal intensity, in some instances, buy an order of magnitude. As such, AC ESI combines the benefits of both MALDI and DC ESI.

DETAILED DESCRIPTION

Figure 1:
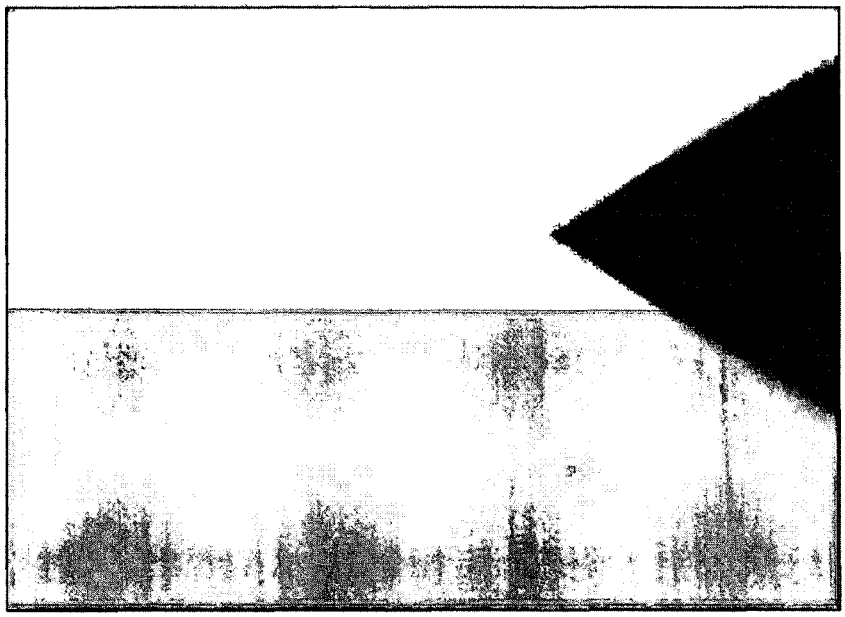
FIG. 1 PRIOR ART
FIG. 1 is a depiction of an example DC electrospray liquid meniscus which forms a steady Taylor cone. A jet emanates from the tip of the cone due to Coulombic fission and subsequently breaks up to form a continuous stream of drops.

The following description of example methods and apparatus is not intended to limit the scope of the description to the precise form or forms detailed herein. Instead the following description is intended to be illustrative so that others may follow its teachings.

The present disclosure relates to an electrospray mass spectrometer device using a high frequency alternating current above 10 kHz that provides a means for generating micron sized drops and molecular ions. An electrospray device is provided comprising one or more micro-needles providing a passageway for transmission of a fluid; one or more conducting elements in electrical communication with the one or more micro-needles; and a source for generating an alternating current electric field with a frequency above 10 kHz across the one or more micro-needles and the one or more conducting elements.

There is also provided a method of producing liquid aerosol drops, the method comprising providing one or more micro-needles; introducing a fluid into the one or more micro-needles; providing one or more conducting elements in electrical communication with the one or more micro-needles;

introducing an alternating current electric field with a frequency greater than approximately 10 kHz across the one or more micro-needles and the one or more conducting elements to induce the ejection of liquid aerosol drops from the one or more micro-needles.

There is provided a method of microsphere encapsulation, comprising providing one or more micro-needles; introducing a fluid into the one or more micro-needles, wherein the fluid comprises a biodegradable material, a solvent and a material to be encapsulated; providing one or more conducting elements in electrical communication with the one or more micro-needles; and introducing an alternating current electric field with a frequency greater than approximately 10 kHz across the one or more micro-needles and the one or more conducting elements to induce the ejection of microspheres from the one or more micro-needles, wherein the microspheres contain the encapsulated material and the microspheres are encapsulated with the biodegradable material.

There is provided a method of fiber synthesis, comprising providing one or more micro-needles; introducing a fluid into the one or more micro-needles, wherein the fluid comprises a biodegradable material and a solvent; providing one or more conducting elements in electrical communication with the one or more micro-needles; and introducing an alternating current electric field with a frequency greater than approximately 10 kHz across the one or more micro-needles and the one or more conducting elements to induce the ejection of fibers from the one or more micro-needles, wherein the fibers comprise the ejected biodegradable material.

DEFINITIONS

Where the definition of terms departs from the commonly used meaning of the term, applicant intends to utilize the definitions provided below, unless specifically indicated.

For the purposes of the present disclosure, the term "AC electrospray" refers to a high frequency alternating current electrospray device.

For the purposes of the present disclosure, the term "drop ejection window" refers to the range of voltage and frequency that yields ejection of drops from an electrospray.

For the purposes of the present disclosure, the term "microencapsulation" refers to the technique of capturing small volumes of liquid, particles, or molecules within a micron sized shell consisting of another material.

For the purposes of the present disclosure, the term "microemulsion" refers to two immiscible liquid phases in a state in which one phase assumes a dispersed medium comprising drops with dimensions on the order of tm and below and the other phase assumes a continuous phase surrounding the drops.

For the purposes of the present disclosure, the term "micro-needle" refers to a syringe with capillary dimensions on the order of approximately 100 μm and below.

For the purposes of the present disclosure, the term "micro-jet" refers to a long slender column of liquid extending out from the tip of a liquid meniscus located at the exit end of a micro-needle.

For the purposes of the present disclosure, the term "electrical communication" refers to a direct or indirect electrical connection formed between two or more elements.

For the purposes of the present disclosure, the term "intermittent" refers to an action or operation that is not continuous across a measured time period, but has time periods of no or differing action or operation

DESCRIPTION

The use of high frequencies, approximately 10 kHz to approximately 280 kHz, or, in some examples, as much as approximately 10 MHz, for the AC electric field leads to new electrospray phenomena in which micron-sized electroneutral drops are generated, see also L. Y. Yeo, D. Lastochkin, S. C. Wang and H. C. Chang, Phys. Rev. Lett., 92, 133902, 2004, the entire contents and disclosure of which is hereby incorporated by reference. The spray modes observed, as well as the electroneutrality and dimensions of the drops produced, are distinct from that in DC electrospraying. Thus, the use of an electrospray is immediately extended to a wider area of possible applications by the teachings of the present disclosure.

Figure 2:
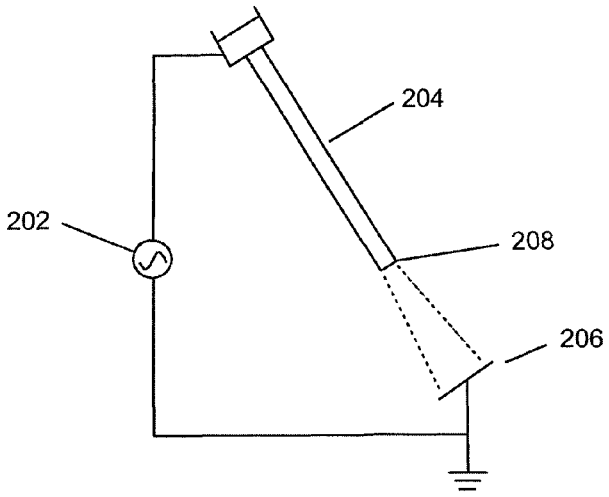
FIG. 2 is a schematic of an AC electrospray apparatus according to one example of the present disclosure.

An experimental setup of an example of an AC electrospray in accordance with the present disclosure is schematically shown in FIG. 2. In this example, a high frequency AC electric field source 202 is connected to a micro-needle 204 and a conducting element 206 that exists as a ground electrode. Liquid is passed through micro-needle 204 by means of a gravitational head (not shown) or a syringe pump (not shown), or other suitable pumps or transmission mechanisms. The electric field acts to pull out a liquid meniscus at micro-needle tip 208 of micro-needle 204. Thus, according to an example of the present disclosure, there is provided an electrospray device comprising one or more micro-needles providing a passageway for transmission of a fluid; one or more conducting elements in electrical communication with the one or more micro-needles; and a source for generating an alternating current electric field with a frequency above 10 kHz across the one or more micro-needles and the one or more conducting elements. A micro-needle of the present disclosure may be placed approximately 1 mm to approximately 25 mm away from the conducting elements. In operation, an electrospray device of the present disclosure may be placed in a vacuum or a gaseous ambient medium. Suitable ambient media include air, vacuum, trace gas, argon, helium, neon, etc. To accommodate the use of various ambient media, the entire electrospray apparatus may be housed in a sealed chamber connected to a vacuum pump or to inlet/outlet gas ports.

Suitable alternating current sources for use in examples of the present disclosure include all possible waveform signals such as sine waves, sawtooth waves, square waves, trapezoidal waves, and triangle waves, amongst others.

Micro-needles of the present disclosure may be any suitable micro-needle now known or later developed including, metal hub micro-needles, metal hub syringe tip micro-needles, hypodermic stainless steel micro-needles, metallic spray heads, nozzles or tubes pierced with a hole, metallic conical tips, glass or plastic capillaries with electrode connections, etc. Micro-needles of the present disclosure may be exposed, insulated, or partially insulated. They may be mounted in various configurations, including horizontal, vertical, or any desired angle with respect to the horizontal plane. Micro-needles of the present disclosure may have channel diameters of between approximately 100 nm and approximately 1 cm.

Conducting elements of the present disclosure may be constructed of any suitable material such as a metallic (e.g., copper, brass, etc.) tape strip. A conducting element of the present disclosure may be a flat strip or a ring, or any other suitable shape.

According to an example of the present disclosure, an alternating current electric field may be provided at a frequency of between approximately 10 kHz and approximately 10 MHz. According to an example of the present disclosure, an alternating current electric field may be provided at a voltage of between approximately 100 V and 50,000 V. According to examples of the present disclosure, there are preferable operating window ranges between approximately 10 kHz and approximately 400 kHz and between approximately 500 V and approximately 5000 V. According to examples of the present disclosure, alternating current electric fields may be approximately greater than 500 V/cm.

In sharp contrast to the steady DC Taylor cone shown in FIG. 1, a conic geometry does not develop at the meniscus according to an example of the present disclosure, as seen in FIGS. 3A, 3B, 3C, and 3D. Instead, the meniscus is pulled forward and a neck develops similarly to drops from a faucet. The drop beyond the neck elongates and expands considerably before the neck pinches off to eject the entire drop. Once the drop is ejected, the meniscus shrinks from its elongated state and the above cycle of events is repeated. The meniscus in an AC electrospray is thus observed to resonate whilst intermittently ejecting drops, in contrast to DC electrospraying in which the meniscus foams a steady Taylor cone from which drop ejection occurs in a continuous fashion. The AC electrospray behavior associated with the present disclosure, which is attributed to the interfacial polarization resulting from atmospheric ionization or interfacial liquid reaction, is not observed in the experiments of Gneist and Bart; their use of a liquid ambient medium suppresses the AC electrospray behavior that is provided by the present disclosure.

The entire pinch-off event lasts several milliseconds, much slower than the streaming pinch-off of DC sprays at the tip of the Taylor cone. The ejected drops are electroneutral due to the large difference in the inverse AC frequency and the ejection time—the number of cations and anions, if they exist in the liquid, that have migrated into the drop due to the AC field should be roughly the same over the relatively long interval for drop pinch-off that contains hundreds or thousands of AC periods. The ejected drops, on the order of approximately 1 μm to approximately 10 μm in diameter, are also comparable or larger than the meniscus dimension and are much larger than the nm sized DC electrospray-created drops. Unlike DC drops, where Coulombic fission that arises from charge repulsion within the drop leads to a relatively small size, AC electrospray-created drops may be larger because of their electroneutrality.

Drops ejected in accordance with examples of the present disclosure may have diameters down to approximately 1 μm.

Figure 4:
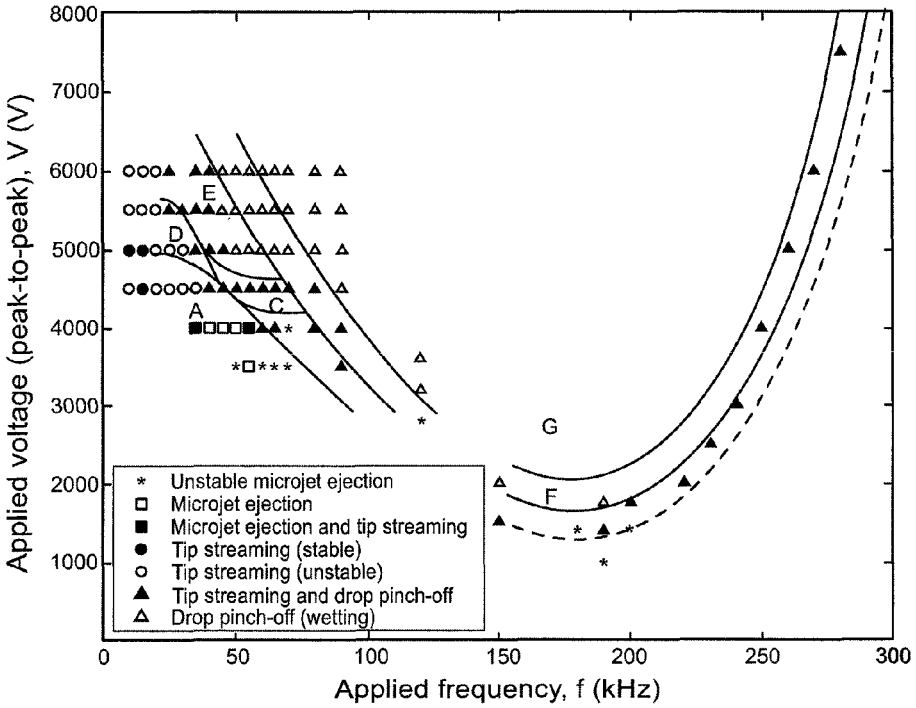
FIG. 4 maps out various AC electrospray regimes in accordance with examples of the present disclosure as a function of the applied voltage and the applied frequency: A Capillary dominant regime (no drop ejection), B—Unstable microjet ejection, C—Microjet ejection with/without tip streaming, D—Stable tip streaming, E—Unstable tip streaming, F—Tip streaming with drop pinch-off (onset of wetting), and G—Drop pinch-off and wetting.
Figure 3A:
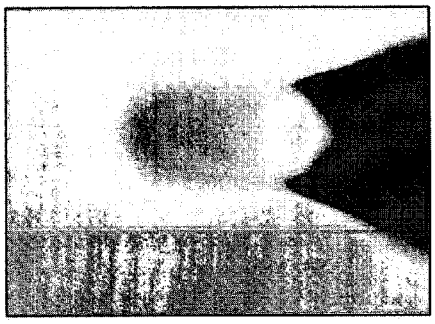
FIGS. 3A, 3B, 3C, and 3D show four consecutive images of AC electrospray of ethanol in air at a frequency of 70 kHz and a root mean squared voltage of 1750 V in accordance with an example of the present disclosure. The frames are about 0.2 milliseconds apart and the captured event represents one drop ejection in a rapid sequence. Note that unlike the conic tips of DC and low-frequency AC sprays, the high-frequency AC electrospray has a rounded tip. Before ejection, the tip region elongates and expands as the neck shrinks until a micron-sized drop is ejected when the neck pinches.
Figure 3B:
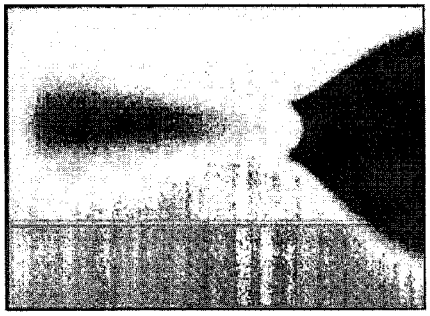
Figure 3C:
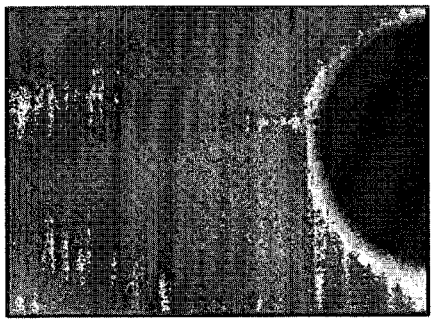
Figure 3D:
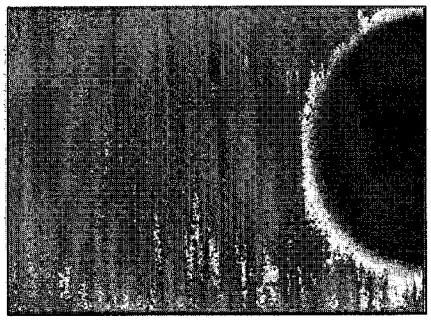

The drop ejection window, characterized by the V-shaped curve in FIG. 4 is a strong function of the applied frequency. The critical onset voltage for drop ejection with typical solvents is approximately 0.5-1 kV, depending on the ambient medium used, compared to the higher critical onset voltage of 2-3 kV required for drop ejection in DC electrospraying.

Figure 5:
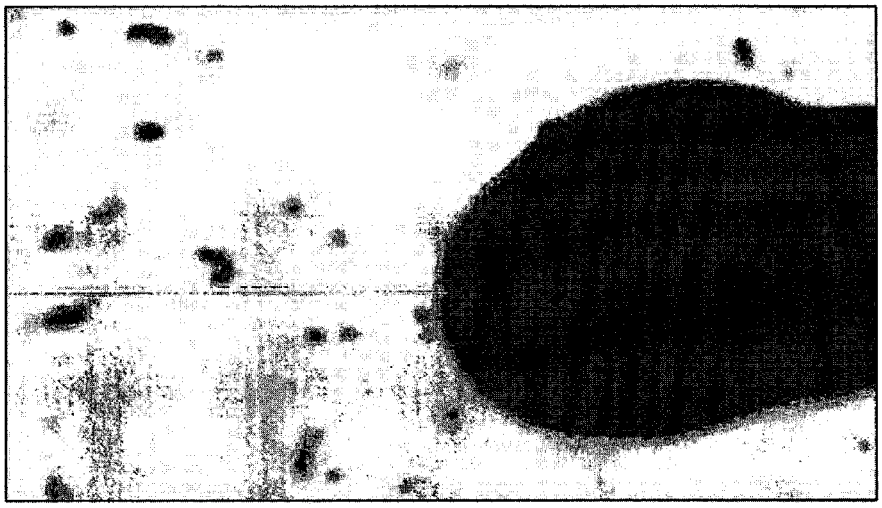
FIG. 5 shows the suppression of drop ejection due to an apparent electrowetting effect at a micro-needle tip at an applied frequency of 45 kHz and a root mean squared voltage of 4500 V in accordance with an example of the present disclosure.

In FIG. 4, the two boundaries of the drop ejection window and their separation both decrease with increasing applied frequency to a minimum at approximately 180 kHz before increasing again; drop ejection ceases entirely beyond approximately 400 kHz. Below the lower boundary of the voltage window, drops are not ejected as there is insufficient electrical stress to overcome the capillary stress in the micro-needle. The upper boundary is signified by a dramatic corona discharge that releases all charges from the meniscus such that it equilibrates into a spherical capillary shape, resulting in the cessation of further drop ejection. Also, at high frequencies and high voltages, an apparent electrowetting effect is observed that pushes liquid in the opposite direction up the micro-needle wall, thus suppressing further drop ejection, as depicted in FIG. 5.

Figure 6:
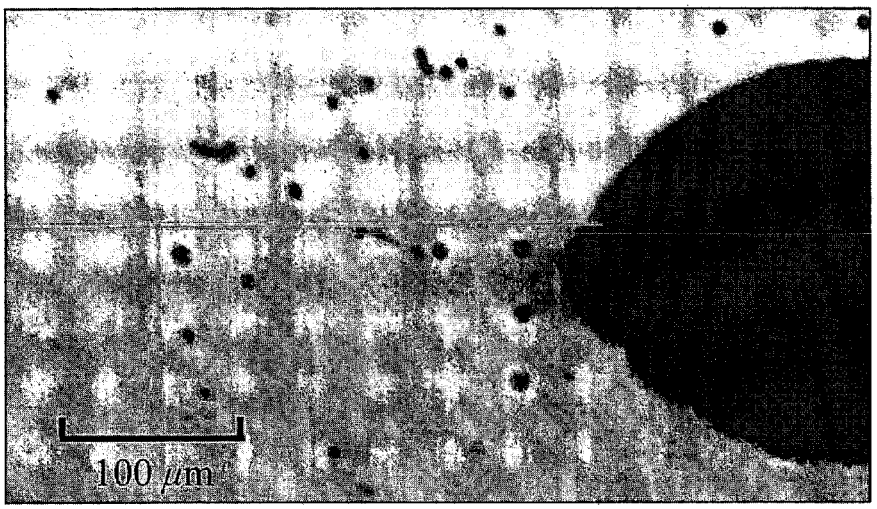
FIG. 6 shows drop ejection by a tip streaming mechanism at a frequency of 10 kHz and a root mean square voltage of 4500 V in accordance with an example of the present disclosure.
Figure 7:
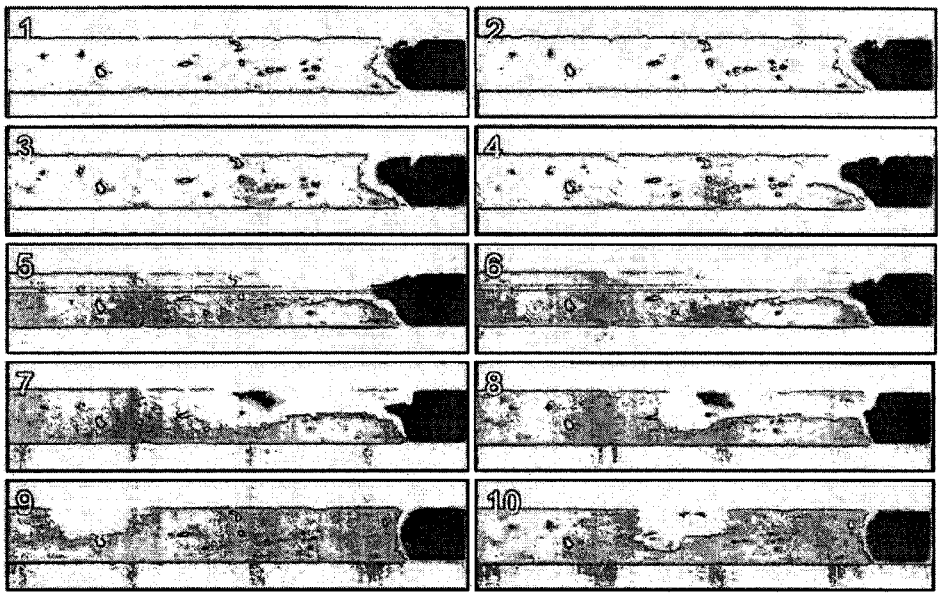
FIG. 7 shows image sequences at 6000 fps taken 300 μs apart illustrating microjet formation and subsequent drop detachment at a frequency of 15 kHz and a root mean square voltage of 4000 V in accordance with an example of the present disclosure.

In accordance with examples of the present disclosure, a meniscus is stable at low voltages and drops are ejected in a periodic manner. At the higher voltages of the operating window, the drops tend to eject in sequences with a long interval between ejection sequences. The meniscus oscillates between the ejection sequences at the capillary-viscous resonance frequency. At low applied frequencies, drop ejection occurs due to viscous pinch-off by a tip streaming mechanism, as illustrated in FIG. 6. As the applied frequency is increased beyond a frequency associated with the viscous-capillary pinch-off frequency of the drop, inertial effects dominate to pull out a long slender microjet, at the tip of which the drop detaches, as shown in FIG. 7.

Several experiments have been conducted with a number of liquids with different relative dielectric constants. Suitable liquids include, by way of example and not limitation, dielectric liquids, electrolytes, methanol, ethanol, dichloromethane, acetone, acetonitrile, or any other suitable liquid or mixture(s) thereof. The operating voltage window for methanol is lower than that of ethanol by a factor of 2 while there is an insignificant difference among the operating windows of ethanol, dichloromethane, and acetone. An ethanol-water mixture of up to 50 percent by weight ethanol produces approximately the same voltage window as pure ethanol. Moreover, changing the ethanol electrolyte composition and conductivity by six orders of magnitude via addition of hydrochloric acid does not significantly change the voltage window or the ejection frequencies. Furthermore, when the water/dielectric liquid volume ratio exceeds about one, the spraying ceases, or at least diminishes to an insignificant amount. This may be attributed to the high ionization potential of water, which does not allow a gas phase ionization reaction to occur. Low volatility of the aqueous solution and high surface tension may also play a role.

Figure 8:
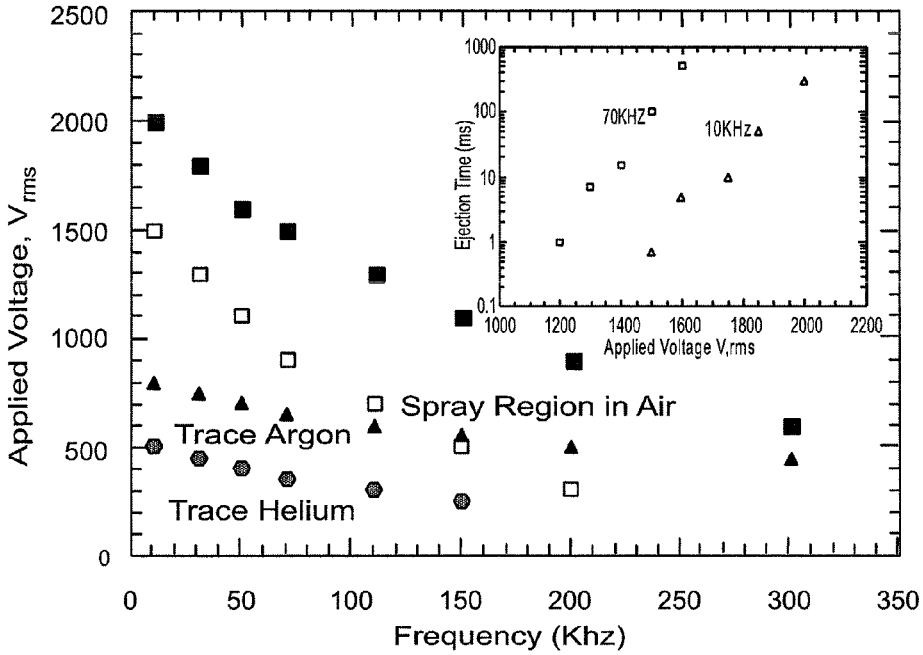
FIG. 8 illustrates the drop ejection window for ethanol in air in the voltage-frequency space represented by the closed and open squares in accordance with an example of the present disclosure. The upper boundaries of the drop ejection window when trace amounts of argon and helium flow over the meniscus are in closed triangles and circles, respectively. The insert depicts the time interval between two successive drop ejection events for ethanol in air in the spray window as a function of applied voltage and frequency. At the lower voltages, the drops are ejected periodically at about a 0.1 ms interval from a stable meniscus. At larger voltages, each ejection event produces a rapid succession of 5-10 drops but there is a longer interval between the events. The meniscus tends to oscillate at the high voltage end of the window.

As depicted in FIG. 8, the drop ejection window is shifted downward thereby lowering the critical onset voltage for drop ejection when air is replaced by inert gases such as argon, helium or neon as the ambient medium. These gases catalyze the ionization of gas which, in turn, results in greater polarization at the meniscus interface for a given voltage, thus enabling drops to be pulled out from the meniscus and pinched-off with greater force.

The production of micron-sized electroneutral drops using examples of the present disclosure provides a design for a portable respiratory drug delivery device that may be administered directly by electrospraying of drug compounds such as asthmatic steroids (beclomethasone dipropionate), insulin or exogenous lung surfactant (Surfactant Replacement Therapy) to treat asthmatic and diabetic patients, and, neonates suffering from Respiratory Distress Syndrome (RDS). When conventional inhalation devices are used, only small fractions of the drug reach the lower airways; most of the drug is deposited in the mouth or throat, and subsequently absorbed in the gastrointestinal tract. Direct local administration to target organs such as a lung provides an immediate effect, thus requiring lower drug quantities compared to oral delivery.

The present disclosure has several advantages over a DC electrospray. The electroneutral drops of the present disclosure do not have to be neutralized before administration to the patient. Moreover, prior research has indicated that uniform distributions of droplets 2.8 mm in size results in optimum dose efficiency, see J. C. Ijsebaert, K. B. Geerse. J. C. M. Marijnissen, J. W. J. Lammers and P. Zanen, J. Appl. Physiol., 91, 2735, 2001; and A. Gomez, Resp. Care, 47, 1419, 2002, the entire contents and disclosures of which are hereby incorporated by reference. The micron-sized drops obtained using an AC electrospray in accordance with the present disclosure therefore present a distinct advantage to the nanodrops obtained using a DC electrospray. One other distinct advantage of the electroneutral drops obtained using an AC electrospray in accordance with the present disclosure is that the low power requirement reduces power consumption, increases safety, and presents potential for the device to be miniaturized to dimensions commensurate with portability.

Thus, according to an example of the present disclosure, there is provided a method of producing liquid aerosol drops, the method comprising providing one or more micro-needles; introducing a fluid into the one or more micro-needles; providing one or more conducting elements in electrical communication with the one or more micro-needles; introducing an alternating current electric field with a frequency greater than approximately 10 kHz across the one or more micro-needles and the one or more conducting elements to induce the ejection of liquid aerosol drops from the one or more micro-needles.

The present disclosure may also be used as a microencapsulation technique to encapsulate drugs, DNA, proteins, osteogenic or dermatological growth factors, bacteria, viruses, fluorescent particles and immobilized enzyme receptors for controlled release drug delivery, bone or tissue engineering, storage of positive controls in clinical or environmental field tests or biosensors for clinical diagnostics and environmental, water or illicit drug monitoring.

A microencapsulation technique of the present disclosure involves spraying a microemulsion consisting of a material to be encapsulated dissolved in water within a continuous phase of organic solvent (e.g., dichloromethane, a dichloromethane/ethanol mixture, a dichloromethane/butanol mixture, etc.) in which a biocompatible and biodegradable polymeric excipient (e.g., poly-glycolic-acid, poly-lactic-acid, poly-L-lactic acid and poly-lactic-acid-glycolic-acid) is dissolved. The solvent evaporates as the spray drops release into the atmosphere, leaving a polymer shell in which the drug is encapsulated.

Thus, according to an example of the present disclosure, there is provided a method of microsphere encapsulation comprising providing one or more micro-needles; introducing a fluid into the one or more micro-needles, wherein the fluid comprises a biodegradable material, a solvent and a material to be encapsulated; providing one or more conducting elements in electrical communication with the one or more micro-needles; and introducing an alternating current electric field with a frequency greater than approximately 10 kHz across the one or more micro-needles and the one or more conducting elements to induce the ejection of microspheres from the one or more micro-needles, wherein the microspheres contain the encapsulated material and the microspheres are encapsulated with the biodegradable material.

Figure 9A:
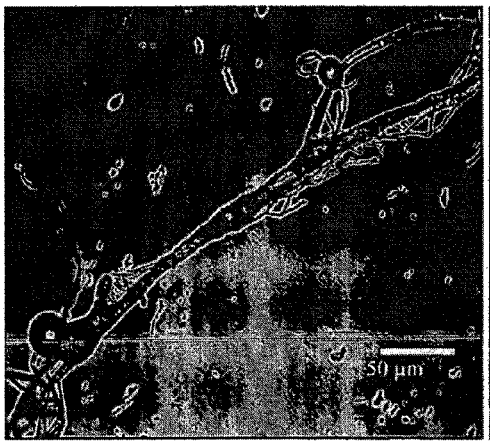
FIG. 9A shows a 10 μm composite fiber that consists of an entanglement of submicron fiber strands.
Figure 9B:
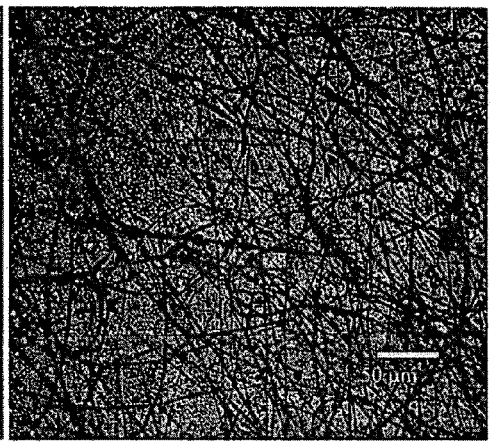
FIG. 9B shows a mesh network of single strand fibers, both of which are synthesized using AC electrospray in accordance with an example of the present disclosure.

A similar technique used for microencapsulation may be used to synthesize bio-fibers for tissue and bone engineering. Composite fibers with diameters between approximately 100 nm and approximately 100 μm, as shown in FIG. 9A, or a mesh network of single strand fibers with diameters between approximately 1 nm and approximately 100 μm with adjustable pore sizes between approximately 10 nm and approximately 1 cm, as shown in FIG. 9B, may be produced. These may be used as surgical threads, medical gauze or bioscaffolds for bone or tissue engineering.

The synthesis of fibers described above with the microencapsulation techniques of the present disclosure allows the encapsulation of dermatological or osteogenic growth factors for bone or tissue engineering as well as antibodies or coloring agents for clothing to be encapsulated within the fiber.

Thus, according to an example of the present disclosure, there is provided a method of fiber synthesis comprising providing one or more micro-needles; introducing a fluid into the one or more micro-needles. wherein the fluid comprises a biodegradable material and a solvent; providing one or more conducting elements in electrical communication with the one or more micro-needles; and introducing an alternating current electric field with a frequency greater than approximately 10 kHz across the one or more micro-needles and the one or more conducting elements to induce the ejection of fibers from the one or more micro-needles, wherein the fibers comprise the ejected biodegradable material.

As noted previously, the basic operation of DC ESI is that sufficiently high, direct current electric potential difference is applied between a capillary through which a liquid sample flows and a counter electrode. The liquid sample (e.g., solvent of the target analyte) exiting the capillary forms a conical meniscus from which droplets containing the target analyte are ejected. These gas-phase droplets undergo two processes, Rayleigh fission and desolvation that eliminate the solvent and produce isolated, gas-phase ions of the target analyte that may then be analyzed by a mass spectrometer.

In contrast, AC ESI as disclosed herein applies a high frequency, alternating current electric potential between the capillary and a counter electrode. For example, referring to FIG. 10, a schematic of an example AC ESI apparatus for mass spectrometry is illustrated and referred to a reference numeral 1000. The example apparatus 1000 includes an alternating current power source 1010, such as, for example, a function generator 1012, a radio-frequency (RF) Amplifier 1014, and a high voltage transformer 1016. The power source 1010 is electrically coupled to an electrospray emitter 1018 and a conducting element 1020 that exists as a ground electrode. Liquid is passed through a micro-needle 1022 by means of the emitter 1018, or any other suitable pump(s) or transmission mechanisms. The electric field acts to pull out a liquid meniscus at micro-needle tip 1024 of micro-needle 1022. The liquid that is emitted from the micro-needle 1022 is passed through a mass spectrometer 1030 for analysis. In this example, the mass spectrometer includes a quadruple mass analyzer and a time-of-flight (TOF) mass analyzer. In other examples, the mass spectrometer may be any suitable mass spectrometer as desired.

Figure 11A:
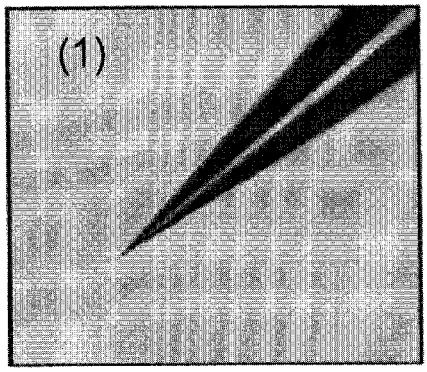
FIG. 11A shows an alternating current cone of ethanol solution with a half cone angle of approximately eleven degrees.
Figure 11B:
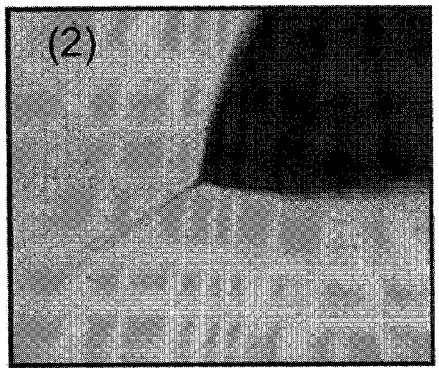
FIG. 11B shows a direct current cone of ethanol solution with a half cone angle of approximately forty nine degrees.
Figure 11C:
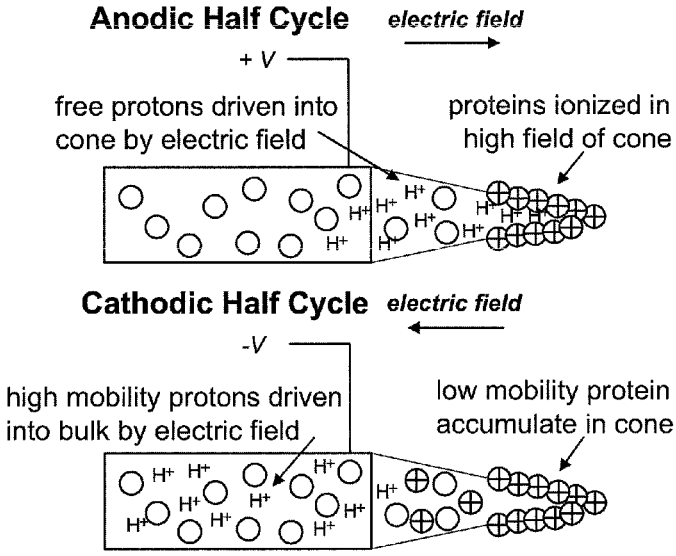
FIG. 11C is a schematic illustration of the ionization and entrainment phenomenon in AC electrospray ionization.

In the illustrated example, the apparatus 1000, the high frequency, AC electrical potential is applied between the micro-needle 1022 and the conducting element 1020 such that upon application of an AC signal of sufficiently high electrical potential (>5 kV peak to peak) and frequency (>50 kHz) across a liquid sample with a relatively low conductivity (<5 μS/cm), the liquid sample exiting the capillary deforms into a unique conical meniscus 1100 with a half angle of approximately 11° (see FIG. 11A). The meniscus formed by the present apparatus 1000 is significantly smaller than meniscus 1110 with a half cone angle of approximately 49° formed by a DC ESI as illustrated in FIG. 11B. Moreover, the AC ESI meniscus 1100 shows continuous axial growth, unlike the DC ESI meniscus 1110. The difference between the mobility of the anions and the cations within the liquid causes an asymmetry in the half cycles of the applied AC electric field. Due to the different relaxation time scales of the charged species, the ions that have low mobility (and hence a higher relaxation time) fail to equilibrate within the meniscus cone 1100 and there is a progressive build up of these low mobility ions, and thus a space charge within the cone. FIG.

11C is a schematic illustration of the ionization and entrainment phenomenon in AC electrospray ionization.

Experiment

Representative proteins cytochrome-c (molecular mass M~12,400 Da) and myoglobin (molecular mass M~17,500 Da) were obtained from Sigma Aldrich (St. Louis, Mo.). Tetra butyl ammonium iodide (molecular weight 369.4) and tetra pentyl ammonium iodide (molecular weight 425.5) were purchased from MP Biomedicals (Solon, Ohio). Stock solutions of myoglobin and cytochrome-c at a concentration 1 mM were prepared in de-ionized (DI) water and further diluted in different mixtures of acetonitrile (ACN) (Sigma Aldrich) and DI water in ratio 1:1 (V/V). The pH ranged from 2.75 to 4.5 (monitored using pH meter) through the addition of varied quantities of formic acid (HCOOH) to yield a 10 μM sample for mass spectrometric analysis. Similarly, a stock solution of 1 mM tetra butyl ammonium iodide and tetra pentyl ammonium iodide was prepared in ACN and diluted in 1:1 ACN/DI water solution to yield a sample solution with concentration of 20 μM, which was used for experiments.

Mass spectra were collected on the mass spectrometer 1303 comprising an Esquire 3000+ spectrometer (Bruker Daltonics Inc.) equipped with a quadrupole ion trap (QiT) mass analyzer. A customized ionization chamber door (not shown) was developed so that the ESI emitter was oriented axially to the mass spectrometer inlet, and was used for back-to-back comparison between the AC and DC ESI experiments. Nitrogen gas ($N_2$) was used as a nebulizing gas at a pressure of 10 psi to aid droplet formation and stabilize both the AC and DC electrospray. Counter-flow drying gas ($N_2$) was used at a flow rate of 3 L/min to enhance desolvation, and a sample flow rate of 0.3 mL/hr was used for all experiments. For DC ESI experiments, protein samples with different pH were injected into the mass spectrometer by directly applying a DC potential of approximately 2 kV onto the emitter using an ES-5R1.2 power supply (Matsusada Precision, Inc.), keeping the end plate at ground (0 V) and capillary inlet to the mass spectrometer at an offset of −500 V. Mass spectra were acquired for 10 minutes. For AC ESI experiments, the protein sample at a single pH of approximately 2.95 was used at frequencies and root mean square (rms) voltages ranging from 50 to 400 kHz and 0.6 to 1.4 $kV_{rms}$. The AC potential was applied using a function generator (Agilent 33220A) connected to a radio frequency (RF) amplifier (Industrial Test Equipment 500A) and a custom made transformer (Industrial Test Equipment Co.). The same procedure was employed for the analysis of quarternary ammonium salts. It should be noted that for accurate measurements of intensity, ion current gain was switched from an automatic acquisition time of 200 ms/spectrum (and ion current target of 20000) to 10 ms/spectrum.

Current/voltage measurements were also conducted independent of the mass spectrometry measurements using the same electrospray emitter (at the same flow rate and nebulizer gas pressure) and a copper plate counter electrode spaced 1 cm apart. The copper plate was maintained at ground (0 V) and AC potential was applied directly to the electrospray emitter. The circuit was grounded to a hard-wired earth ground in the laboratory that led outside of the building. The current was recorded using a picoammeter (Keithley 6485), and the emitter voltage was measured with an oscilloscope (Tectronix TDS2014) coupled with a high voltage probe. Protein samples at pH 2.75 were studied at frequencies ranging from 50 kHz to 170 kHz were used, and the current was recorded at an interval of 0.2 s for approximately 5 minutes. After this time period, the current magnitude started to reduce gradually due to the deposition of unevaporated liquid on the counter electrode and no further measurements were made.

Figure 12A:
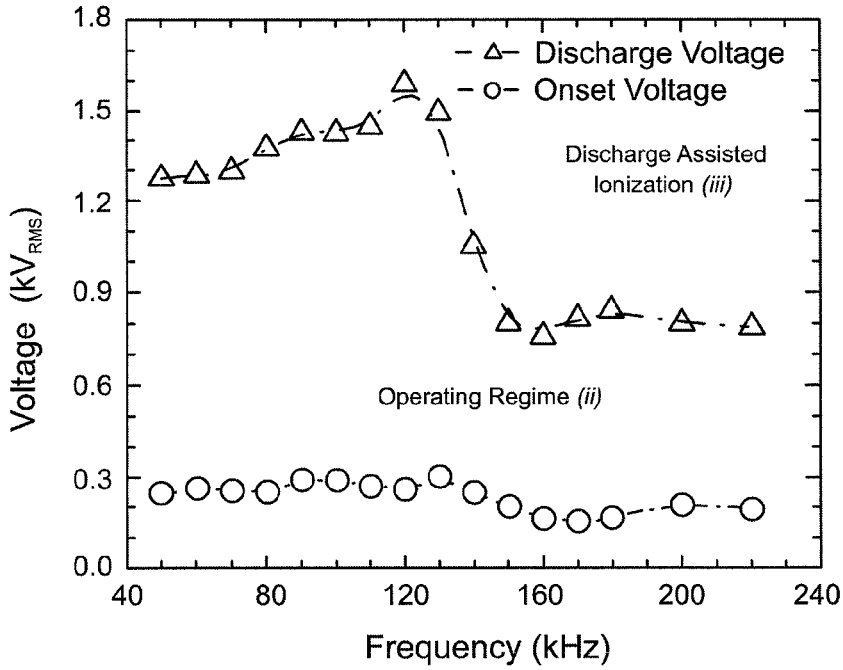
FIG. 12A illustrates an example characteristic AC rms voltage-frequency phase space for a mass spectrometry experiments conducted with an example system similar to that in FIG. 10.
Figure 12B:
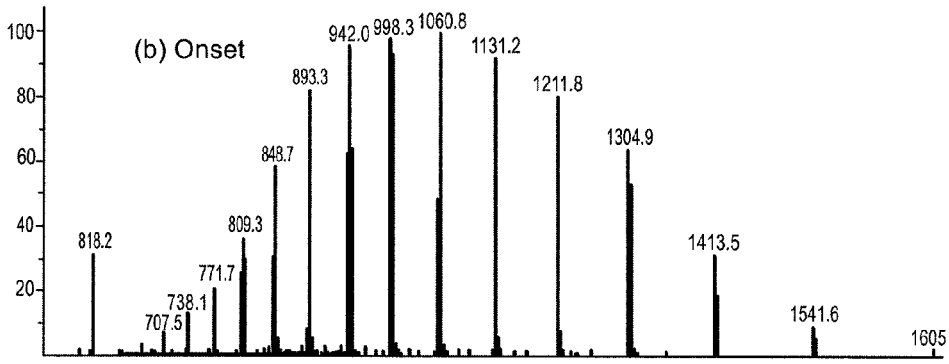
FIG. 12B illustrates an example onset voltage as which the mass spectra signals corresponding to the analyte ions are initially observed.
Figure 12C:
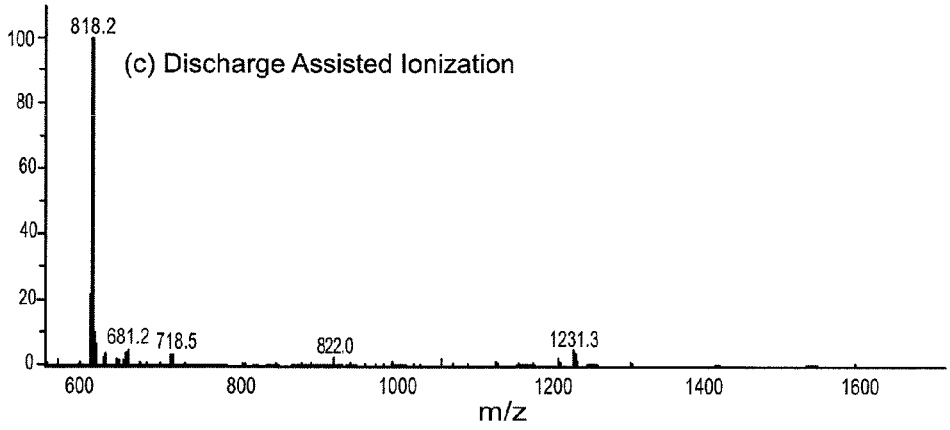
FIG. 12C illustrates the threshold rms voltage beyond which the total signal and peaks disappear for the example mass spectrometry experiments.

FIG. 12A indicates a characteristic AC rms voltage-frequency phase space for the mass spectrometry (MS) experiments. Three distinct regimes can be identified in FIG. 12A are demarcated by: (1) The Below Onset Regime, which is the regime below the onset rms voltage in which no signals were observed and only noise was recorded; (2) The Operating Regime, The stable operation regime, with voltage greater than the onset voltage, in which MS signals corresponding to the analyte ions, distinct from noise, were observed as shown in FIG. 12B; and (3) The Discharge Regime: The regime beyond the threshold rms voltage in which the peaks corresponding to the apo-myoglobin ions disappeared and only the heme group was observed, as evident in FIG. 12C Thus two critical voltages—onset and discharge—bound the operating regime for AC ESI mass spectrometry. The discharge regime in AC ESI is characterized by a corona discharge with a strong confined glow at the tip of the emitter, which can be directly visualized in the dark. The disappearance of apo-myoglobin peaks during MS in the discharge regime can be compared with corona discharge-driven atmospheric pressure chemical ionization (APCI) MS, where only low molecular weight proteins (~600 Da) are observed while higher molecular weight proteins do not appear at all. This is possibly the case observed here with AC ESI MS in the discharge regime where only the low molecular weight species, heme group (m/z~616) was observed, while the peaks corresponding to the large apo-myoglobin disappear completely. The alternate plausible mechanism for the disappearance of apo-myoglobin peaks in discharge regime is due to the creation of bigger charged droplets when the corona discharge is formed. Given that the heme group is highly hydrophobic and that the remaining apo-myoglobin is hydrophilic in nature, it is hence more favored for formation of ion during the flight of charged droplet and hence is recorded in mass spectrum. On the other hand, the apo-myoglobin molecule occupies the liquid bulk of a charged droplet and therefore cannot form a gas phase molecular ion, potentially leading to its disappearance in the discharge regime.

Figure 13:
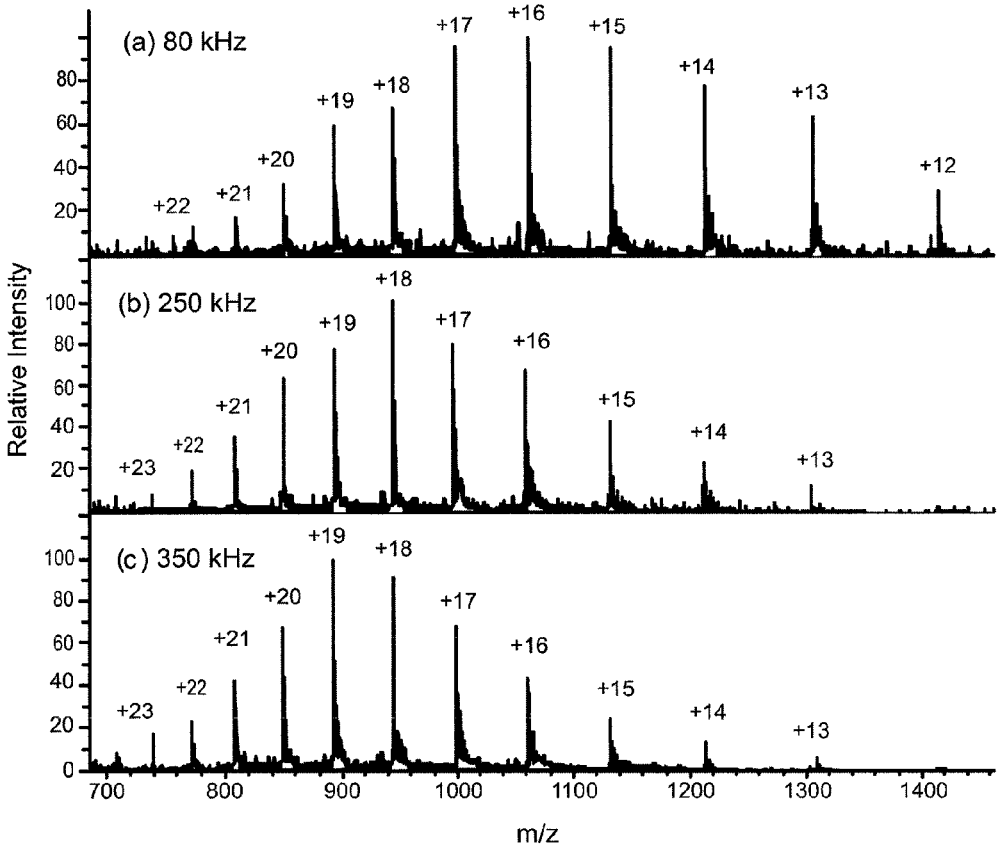
FIG. 13 illustrates a Guassian distribution of charge states for the example mass spectrometry experiments.
Figure 14:
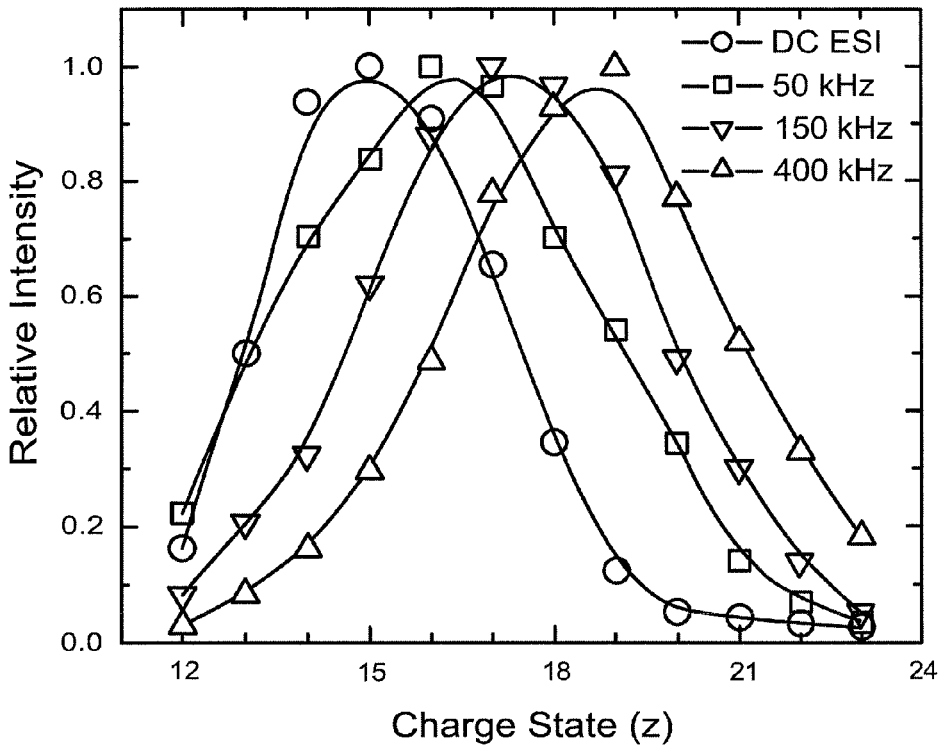
FIG. 14 illustrates an example charge state envelope for the example mass spectrometry experiments.

Apart from the strange disappearance of the apo-myoglobin peak from the mass spectra in the discharge regime, there was also anomalous behavior of the mass spectra by varying the frequency in the stable operating regime. For apo-myoglobin, a near symmetric Gaussian distribution of the multiply charged peaks, centered at charge state value of +13, is typically observed for DC ESI at pH of 4.1. As the pH value is reduced, the symmetric Gaussian distribution becomes skewed; with the mode moving toward higher charge states and the peak of the charge state distribution shifting to a value of +16 at a pH of 2.75 (not shown). This occurs because at lower pH, the protein molecule unfolds, which allows for a larger degree of protonation, and consequently leads to higher charged states are observed in the mass spectrum. When using AC ESI for myoglobin at a pH of 2.95, a behavior similar to DC ESI is observed at low frequencies (approximately 50 kHz)), with the peak of the distribution centered at +16. However, as the frequency is increased, the distribution continues to skew and the peak shifts toward higher charge state values as shown in FIGS. 13 and 14. For example, at frequencies ~350 kHz or higher, the peak of the charge state distribution is +19. This curious frequency-dependent behavior is again attributed to the entrainment characteristic of AC ESI. As the frequency increases, a greater number of half cycles occur over a given time window, and more protons are periodically driven into and out of the cone, while the low mobility charged protein molecules accumulate near the meniscus after every cathodic half cycle. As such, this to and fro motion of protons enhances their chance to attach to an already protonated protein molecule, thereby increasing its charge state. Effectively, as the frequency the local pH at the tip of the cone is reduced because of a greater influx of protons into the cone, thus resulting in the significant shift of analyte peaks in the mass spectra. Similar effects for cytochrome-c (not shown) were also observed to confirm this charge state effect.

Figure 15:
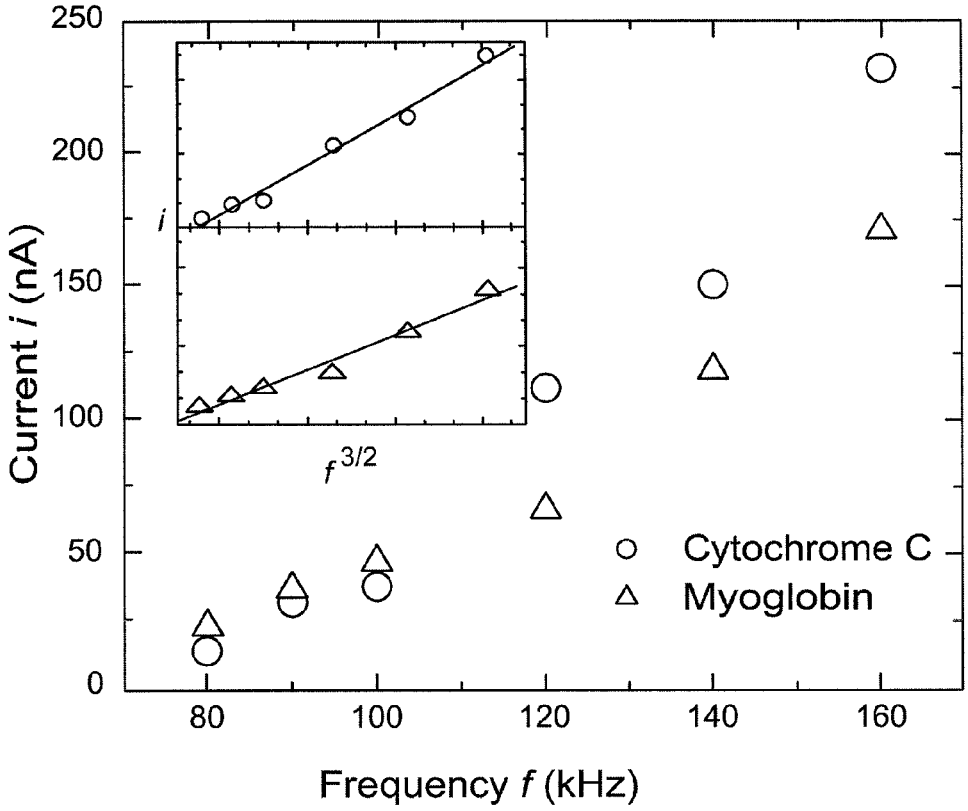
FIG. 15 illustrates an example monotonically increasing trend of current with frequency for the example mass spectrometry experiments.

To further clarify how the entrainment effect may modulate pH, current measurements were carried out at different frequencies but constant rms voltage. These measurements showed a monotonically increasing trend of current with frequency (FIG. 15). In order to investigate this trend, we carry out a simplified scaling analysis of ion transport in the AC cone. To arrive at the governing equations, we return to the mechanism of formation of AC electrosprays described earlier in the present report. While the ionization of apo-myoglobin molecules primarily occurs during the anodic half cycle, diffusion can be assumed to be the primary means of transport of charged apo-myoglobin molecules during the cathodic half cycle owing to their low mobility, while the high mobility free protons are electrophoretically driven towards the counter electrode. Therefore, the distribution of protein ions in the cone during the cathodic half cycle can be described by the equation given by Equation 1:

$$\frac{\partial \rho}{\partial t} = D\frac{\partial^2 \rho}{\partial x^2} \quad \text{Eq. (1)}$$

where ρ is the charge density corresponding to that of protonated protein ions, t is the time, D is the diffusion coefficient of the proteins, and x is the coordinate direction along the axis of the cone.

For modeling purposes, we assume that the protonation occurs near the tip of cone so that the resulting charge q that is generated by ionization after each anodic half cycle can be considered to be a point charge. This serves as the initial condition when the cathodic half cycle begins and can be mathematically represented by a Dirac delta function of value q. Additionally, since the dimension of the fluid into the bulk is much greater than the length of the cone, this problem can be treated as an infinite domain (axially) where the charge density goes to zero at long distances. The solution of the diffusion equation is given by Equation 2:

$$\rho(x, t) = \frac{q}{\sqrt{4\pi Dt}} e^{\frac{-x^2}{4Dt}} \quad \text{Eq. (2)}$$

The two relevant scales in this equation are the length scale λ and the time scale 1/f, corresponding to the period of an AC cycle. For an acidified solution containing protein molecules, with a diffusion coefficient $D \sim 10^{-6}$ $cm^2/s$ [21] and conductivity ~100 μS/cm, the double layer thickness is $\lambda \sim 10^{-5}$ cm. The corresponding Maxwell relaxation time scale (or alternatively, the diffusion time scale) is given by $\lambda^2/D$ and is approximately $10^{-4}$ s, an order of magnitude less than the time scale corresponding to the inverse of frequency (f~100 kHz). Thus, in the limit $1/f \ll \lambda^2/D$, the pre exponential factor dominates the exponential term in (2). Therefore, for these AC fields the charge density, ρ, should scale as the inverse of the square root of the half period, $$\rho \sim 1/\sqrt{t} \quad \text{Eq. (3)}$$

Since the frequency f is the reciprocal of this time scale t, $f \sim t^{-1}$, the charge distribution in the cone after each cathodic half cycle will scale as:

$$\rho \sim f^{1/2} \quad \text{Eq. (4)}$$

Over the course of N AC periods (or half periods), the total accumulated ion concentration in the cone can be approximated by a summation $$\rho_N \sum_N \rho = N\rho \quad \text{Eq. (5)}$$

For a given time T, the number of periods is proportional to the AC frequency, N~f. Thus the net ion accumulation over many periods will be the product of $\rho_N \sim f \cdot f^{1/2}$ or $$\rho_N \sim f^{3/2} \quad \text{Eq. (6)}$$

From earlier visualization, droplets eject from the cone at a frequency of ~100-1000 Hz, corresponding to approximately ~100-1000 AC periods. These droplets will eject the accumulated charge $\rho_N$ of the many AC periods, leading to a current i. The current, therefore, should follow a similar scaling behavior as the ion concentration such that $$i \sim f^{3/2} \quad \text{Eq. (7)}$$

The inset of FIG. 15 shows measured current plotted as a function of $f^{3/2}$ along with linear curve fits, confirming this scaling theory and lending confidence to the mechanism that charges are created and entrained in the AC cone.

One important potential application of this frequency-dependant entrainment in AC ESI could come in the form of reducing problems induced by ionization suppression widely observed in DC ESI mass spectrometry. In DC ESI, the conventional understanding is that molecular ions are formed either through desorption from charged droplets (the ion evaporation model) or through Rayleigh fission. In either of these two mechanisms, if there are two (or more) analyte molecules in a droplet, there is competition between the molecules for ion formation, which leads to suppression of ion peaks in the mass spectrum. This is often attributed to differences in the surface activities and/or sizes of the two molecules. The finite number of charges in the droplet are often assumed to relax perfectly to the surface, and the more hydrophobic molecule screens the more hydrophilic molecule from access to the charges, limiting ionization. On the other hand, current understanding of AC ESI is that the ionization reactions occur predominantly in the cone itself, as opposed to through droplet chemistry. One potential implication of this "cone ionization" mechanism is that it could mitigate the droplet chemistry that results in ionization suppression.

Figure 16A:
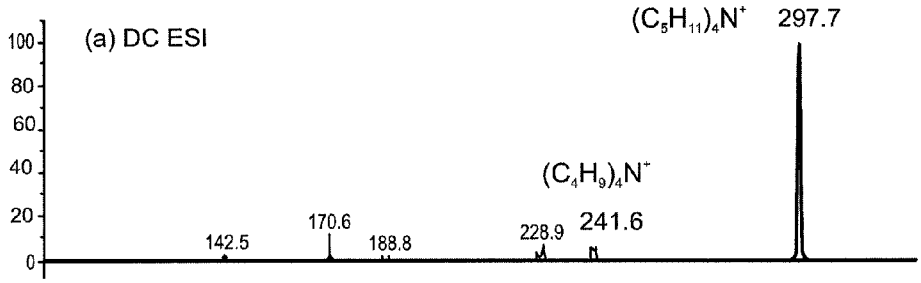
FIGS. 16A-16C illustrate an example mass spectra for a direct current electrospray and for the example mass spectrometry experiments.

To study this effect, an equi-molar mixture of two surfactant molecules $(Butyl)_4N^+I^-$ (m/z=241.7) and $(Pentyl)_4N^+I^-$ (m/z=297.7) with different surface activities was studied. For small molecules, ion evaporation has been proposed as the dominant ionization mechanism in DC ESI. Based on this mechanism, the Thomson-Irabarne model predicts that the ratio of the mass spectrum intensities for two analyte molecules should be the ratio of their gas phase ion sensitivity coefficients, which is directly proportional to the surface activity of the respective molecular ions. That is, the ratio of intensities I of the tetraalkylammonium ions should be $$\frac{I\lfloor (Pentyl)_4N^+ \rfloor}{I[(Butyl)_4N^+]} = \frac{k_p}{k_b},$$

where $k_p$ and $k_b$ are the gas phase ion sensitivity coefficients of the pentyl and butyl tetraalkylammoniums, respectively. If the molecule with higher surface activity, and thus a greater tendency to ionize, is in the numerator, the equation will give a ratio>1. If surface activity plays no role, then this ratio should tend toward 1 for an equi-molar mixture, implying no ionization suppression. Because $(Pentyl)_4N^+I^-$ has a greater surface activity than $(Butyl)_4N^+I^-$, it should suppress the $(Butyl)_4N^+I^-$ signal, and this is clearly evident in the DC ESI mass spectrum shown in FIG. 16A, in which the ratio of intensity of the two ions $$\frac{I[(Pentyl)_4N^+]}{I[(Butyl)_4N^+]} \sim 10.$$

Figure 16B:
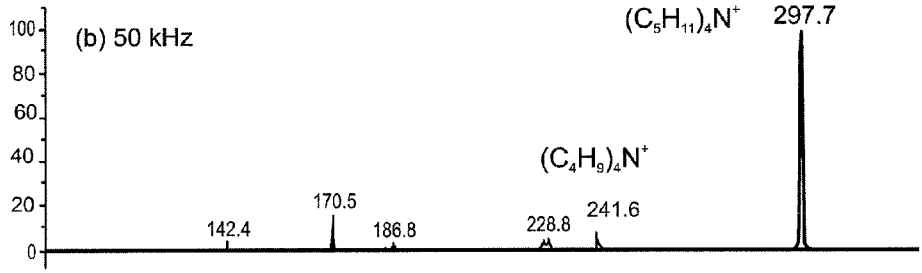
Figure 16C:
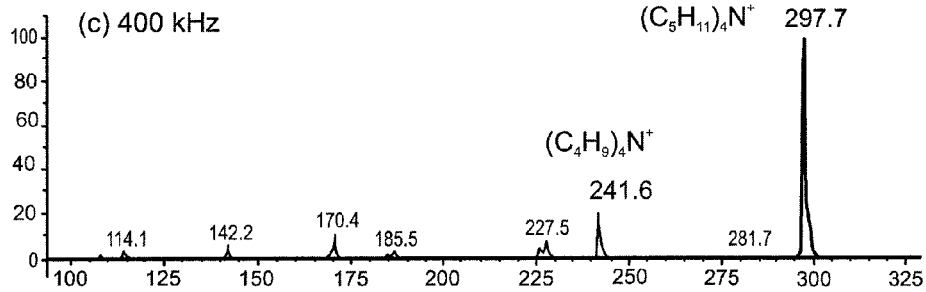
Figures 16D, 17A:
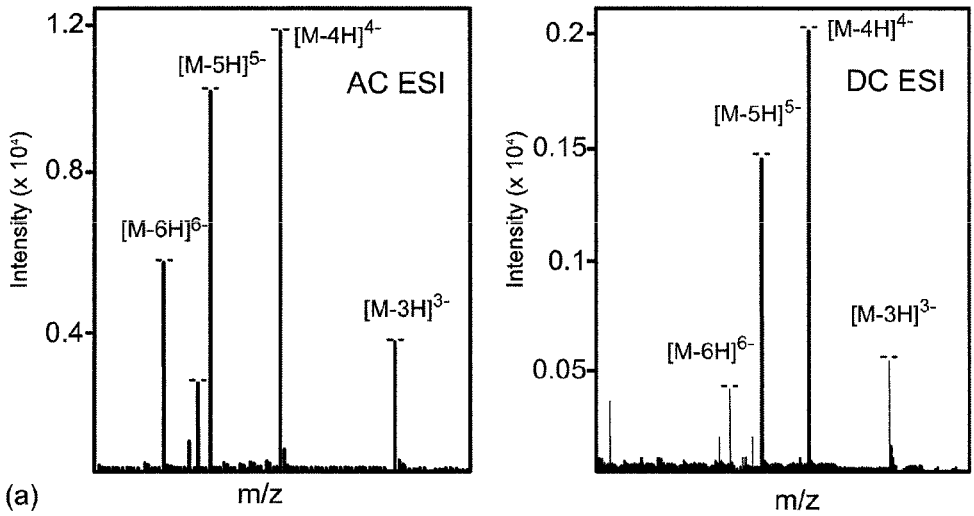
FIG. 16D is a table illustrating a ratio of the signal intensities for two different ions for various frequencies for the example mass spectrometry experiments.
FIGS. 17A and 17B illustrate a side-by-side comparison of negative mode mass spectra obtained using high-frequency alternating current electrospray and a direct current electrospray.

Low frequency (<150 kHz) AC ESI behavior, as shown in FIG. 16B closely resembles the DC ESI spectra. However, as evident from FIGS. 16C and 16D, at much higher frequencies (>250 kHz), the ratio reduces to $$\frac{I[(Pentyl)_4N^+]}{I[(Butyl)_4N^+]} \sim 4.$$

This suggests that at high frequency, AC ESI reduces the role that surface activity plays during ionization. Because the AC field would play little role in ion evaporation ionization from the droplets, these results imply that the ionization is not occurring in the droplets emitted by AC electrospray, and that "cone-ionization" mechanism is at play. Conceptually, this can be explained in a following manner. In droplet chemistry, ionization suppression is due to analyte molecules competing for a finite number of charges in the droplet. In the cone chemistry of an AC electrospray, however, the analyte molecules have access to more charges since they are replenished from the bulk solution every half cycle at a much faster rate (~100 kHz) than droplets are ejected (~100-1000 Hz). As such, surface activity plays a smaller role in AC ESI, and ionization suppression is reduced. However, it should be noted that since the ratio did not decrease to a ratio of unity but only decreased by a factor of 2, there is likely still droplet chemistry occurring to create analyte ions in AC ESI, but that the predominant ionization is likely occurring in the cone itself.

Thus, in this example, higher order qualitative features of frequency dependent characteristics of AC ESI mass spectrometry are reported and are supplemented by voltage and current measurements and appropriate scaling laws. Three distinct voltage/frequency regimes of AC ESI behavior are identified, including the disappearance of analyte peaks at voltages higher than a threshold voltage. In addition, the charge state distribution in the resulting mass spectra can be distorted by the operating frequency, and at higher frequencies, a skewed Gaussian profile is obtained. By comparison to DC ESI at varying pH, the AC ESI effect is attributed to a local pH modulation in the cone itself that occurs due to the increased number of half cycles at higher frequencies. The effect of increased frequency is affirmed through current/voltage measurements that showed a distinct dependence on frequency as $f^{3/2}$, which is a result from the preferential entrainment of low mobility ions in the AC cone. Additionally, by ionizing predominantly in the cone itself, AC ESI reduces the detrimental effects of ion suppression frequently observed in DC ESI.

In another example experiment, high purity HPLC grade representative 10-mer oligonucleotides with a molecular mass M~3040 Da were obtained from Invitrogen Inc. and were prepared in 1:1 (vol/vol) acetonitrile (Sigma Aldrich, St. Louis, Mo., USA) and deionized water. High purity grade oligonucleotide samples were used to ensure that the mass spectra obtained were clean and interference from impurities present in the sample was minimized. The protein samples, cytochrome c with a molecular mass M~12,400 Da (Sigma Aldrich) and myoglobin with molecular mass M~17,000 Da (Sigma Aldrich), were also prepared in 1:1 ratio (vol/vol) of acetonitrile and de-ionized water with an addition of 1:1000 formic acid to facilitate the formation of positive ions.

Figure 10:
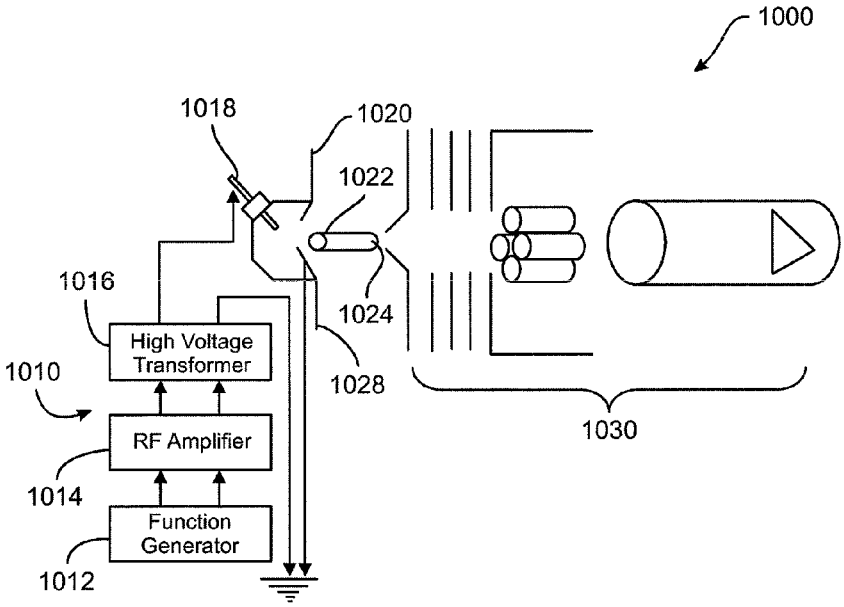
FIG. 10 is a schematic of an example alternating current electrospray mass spectrometer system.

Mass spectra were collected on both an UltrOTOF-Q mass spectrometer (Bruker Daltonics Inc.) equipped with a hexapole in series with a quadrupole, and coupled with a time-of-flight (TOF) mass analyzer and an Esquire 3000+ (Bruker Daltonics Inc., Billerica, Mass., USA) equipped with quadrupole mass analyzer, and both were equipped with a native DC ESI source and chamber. For AC ESI experiments, the end plate was set to 0 V and a high-frequency AC potential was directly applied to the emitter, as shown in FIG. 10. To avoid any damage to the equipment, the vendor's metal ESI chamber was customized, and a new emitter mount made out of insulating material was used in all the experiments. For the DC ESI experiments, two electrical configurations were used. In Configuration I, the end plate voltage was set to 3200 V using the inbuilt power source of the mass spectrometer while the emitter was kept at ground, which is the standard operation for these mass spectrometers. In Configuration II, for direct comparison with AC ESI, an external DC voltage source applied a high potential directly to the emitter while the end plate was set to 0 V. This mimicked the electrical configuration of the AC ESI experiment. In both configurations, the DC ESI potential difference was set to equal the root mean square (RMS) voltage of the AC signal. The ion optics were set to optimize the signal intensity and remained constant between AC and DC ESI experiments for comparison. Additionally, in both AC and DC ESI experiments, nitrogen gas was used as a nebulizing gas at a pressure of 2 bars to aid droplet formation and stabilize the electrospray, and also as a counter-flow drying gas at a flow rate of 5 L/min to enhance desolvation. A sample flow rate of 4 μL/min was used.

FIG. 17 shows a side-by-side comparison of negative mode mass spectra obtained using high-frequency AC ESI and Configuration I DC ESI for 100 μM 10 base oligonucleotides. It is evident that the qualitative behavior of both ionization techniques is comparable in the sense that ions with same charge states (m/z) are produced. This observation indicates that the mechanism for the formation of ions in the gas phase, either by successive Rayleigh fission or desorption, is the same for both AC and DC ESI. The striking difference between the two mass spectra is in terms of the ion intensity, where the AC ESI signal is an order of magnitude more intense than the DC ESI signal, a result of two mechanisms in the formation of an AC electrospray.

Figure 17B:
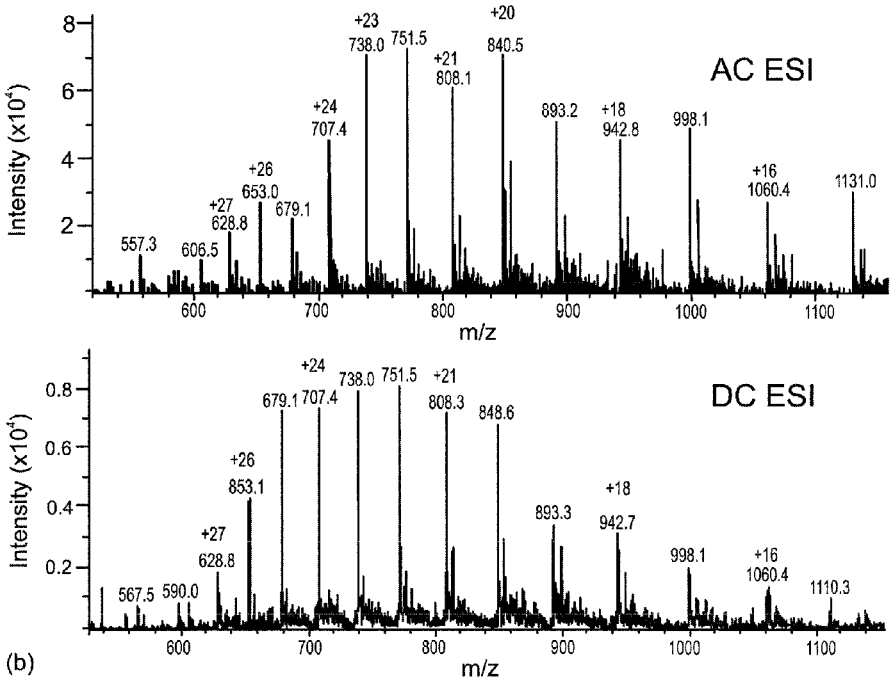

A similar trend is depicted in FIG. 17B for a positive mode mass spectrum of 40 μM myoglobin using Configuration I DC ESI experiments, and again AC ESI produced a nearly order of magnitude increase in the signal intensity. It should be noted that these spectra are illustrative of consistent trends that were observed with various samples, and that AC ESI spectra were obtained for concentrations a low as 2 μM with S/N>10. DC ESI, in comparison, yielded much lower S/N ratio at the same concentrations. It should be understood that with further optimization even better AC ESI performance is possible.

The mobility of the oligonucleotide anions $[M+nH]^{n-}$ (or $[M+nH]^{n+}$ for myoglobin) is orders of magnitude lower than that of the other ions present in the solution, and they are preferentially entrained towards the tip of the AC cone, resulting in a higher "pseudo" concentration of charged biomolecule near the tip of the cone. Additionally, without electrons populating the ejected drops, a coarser size distribution of droplets ejected from the tip of the AC cone indicates that the surface charge density on a droplet is much less than that of droplets ejected from a DC cone. The smaller surface charge density delays Rayleigh fission and, due to the reduced electrostatic repulsion between the droplets, the plume of ejected droplets (and the subsequent generations of droplets obtained by Rayleigh fission) for an AC electrospray is much thinner in comparison to that of DC cones. This was confirmed by observing the AC and DC cone cases directly under an optical microscope in which the plume of droplets were clearly visible due to scattering of fluorescent light. As such, a more directed beam of ions enters the MS, minimizing ion loss. These two unique characteristics of an AC cone, preferential entrainment of low mobility ions in the cone and a more confined plume of ejected droplets, together contribute to the higher AC ESI signal intensity.

Figure 18:
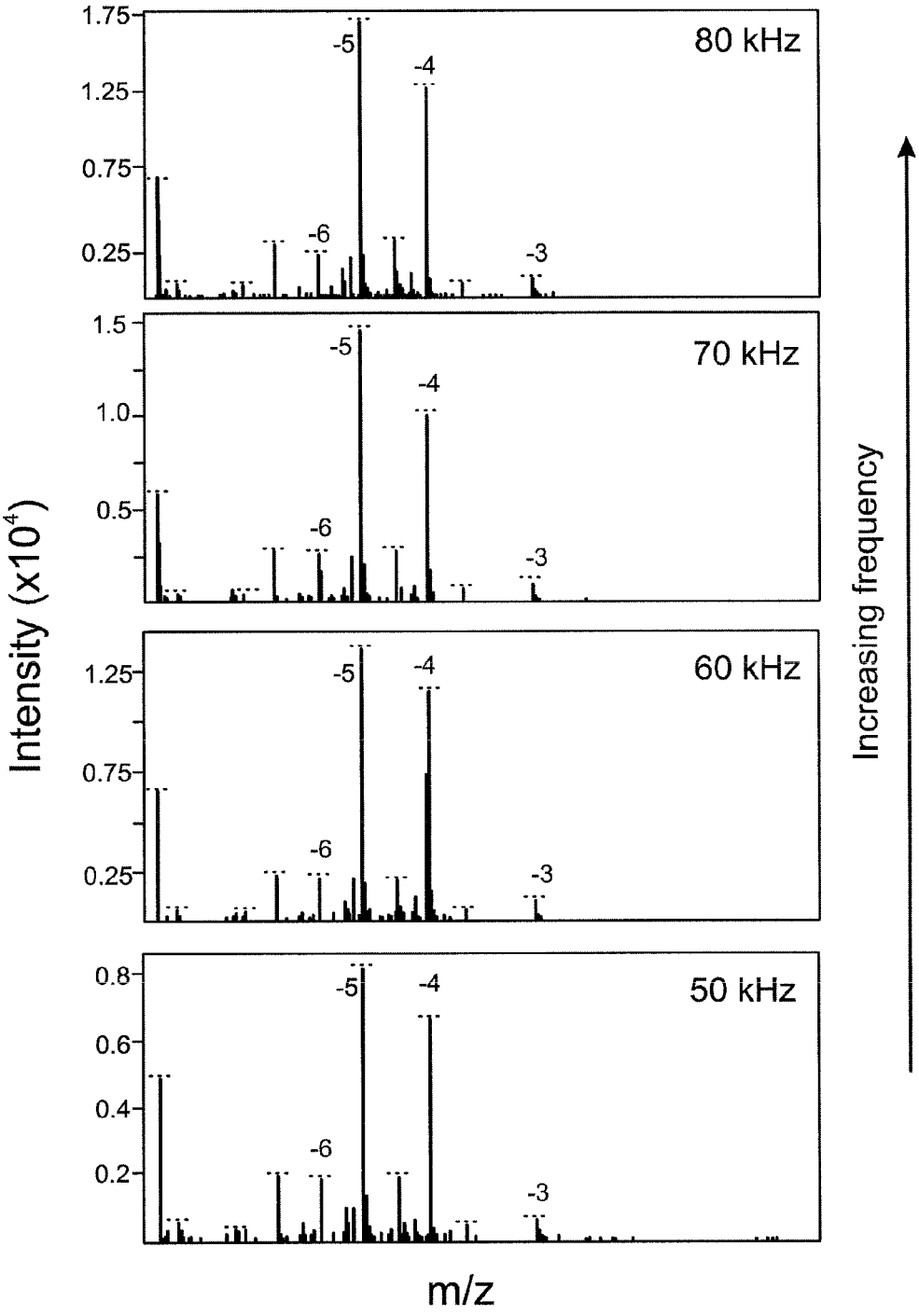
FIG. 18 illustrates the mass spectra of representative oligonucleotides at different applied AC frequencies.

The pronounced effect of preferential entrainment of ions is evident from FIG. 18, which depicts the mass spectra of representative oligonucleotides at different applied AC frequencies. As the frequency increases, a greater number of half AC cycles are accommodated over a given time. As such, at higher frequencies, the degree of ionization and subsequent concentration of oligonucleotides after every half AC cycle is enhanced within the AC cone resulting in higher signal intensities for higher frequencies. However, as shown by the modest increase from 70 to 80 kHz, it is expected that at some frequency the signal will be optimized.

In contrast to the negative mode mass spectrum of oligonucleotides, AC ESI can also be used for positive mode MS (e.g., cytochrome c and myoglobin). This is again due to the generation of protonated protein molecules in the AC cone that are driven toward the tip of the cone and eventually ejected from the cone, as shown in FIG. 12B for myoglobin and in the supplementary material for cytochrome c (where DC ESI was operated in configuration II). As such, the high-frequency AC field can produce both negative and positive ions depending on the mobility of the species. When the low mobility ions are cations, AC can be used for positive mode mass spectrometry and vice versa for anions.

Thus, AC ESI has been demonstrated as a viable soft ionization method for mass spectrometry, with distinct advantages over DC ESI owing to the preferential entrainment mechanism. Moreover, the more confined and directed beam of drops (and hence ions) generated by AC ESI, in conjunction with pre-concentration of low mobility ions, lead to a better signal intensity potentially reducing the limit of detection by an order of magnitude. In addition to enhanced signal intensity, AC ESI can be used for in situ separation of undesirable high mobility ions (like $Na^+$ and $K^+$) that are likely to interfere with mass spectra by forming adducts with target analyte molecules. The variation of the mass spectra as a function of frequency may lead to a bispectral characterization of heterogeneous samples, particularly if selective fragmentation can be induced for more fragile molecules by a negative ramp of the frequency. The potential union of AC ESI with nanospray emitters and use in series with HPLC could ultimately result in cleaner mass spectra and reduction in the limits of detection by orders of magnitude, making AC MS ESI mass spectrometry a promising tool for the analysis of samples with ultra low concentration.

Although certain example methods, apparatus, and systems have been described herein, the scope of coverage of this patent is not limited thereto. On the contrary, this patent covers all methods, apparatus, system, and articles of manufacture fairly falling within the scope of the appended claims either literally or under the doctrine of equivalents.

We claim:

1. An alternating current electrospray mass spectrometry device comprising:

an electrospray device having at least one emitter providing a passageway for transmission of an analyte sample;

at least one conductive element in electrical communication with the at least one emitter;

a source for generating an alternating current electric field coupled to the at least one emitter, wherein the electric field forms a liquid cone at a tip of the at least one emitter and ionizes the analyte sample present in the liquid cone, and wherein further, the frequency of the electric field is greater than the inverse of a charge relaxation time of the ionized analyte sample thereby entraining low mobility ions in the liquid cone, wherein the alternating current electric field causes the emitter to discharge the liquid cone as a liquid aerosol drop; and a mass spectrometry device fluidly coupled to the electrospray device to receive the produced liquid aerosol drop and analyze the ionized analyte sample to determine the composition of the analyte sample.

2. A device as defined in claim 1, further comprising an electromagnetic field proximate the discharged liquid aerosol drop to separate the ionized analyte sample according to the ionized analyte sample mass-to-charge ratio.

3. A device as defined in claim 2, further comprising a detector to detect the ionized analyte sample within the liquid aerosol drop.

4. A device as defined in claim 1, wherein the concentration of the ionized analyte in the tip of the liquid cone effectively changes the local pH.

5. A device as defined in claim 4, wherein the analyte is a protein that unfolds in response to the pH change leading to enhanced protonation of the protein.

6. A device as defined in claim 1, wherein increasing a frequency of the generated alternating current electric field produces an increased concentration of low mobility ions in the liquid cone.

7. A device as defined in claim 1, wherein a voltage applied by the source for generating an alternating current electric field is between an onset voltage and a threshold voltage for the frequency being applied by the source.

8. A device as defined in claim 1, wherein the mass spectrometer is operated in positive mode when the low mobility ions are cations.

9. A device as defined in claim 1, wherein the mass spectrometer is operated in negative mode when the low mobility ions are anions.

10. A device as defined in claim 1, wherein the at least one emitter has a channel diameter of between approximately 100 nm and approximately 1 cm.

11. A device as defined in claim 1, wherein the at least one conducting element is located between approximately 1 mm and approximately 25 mm from the tip of the emitter.

12. A device as defined in claim 1, wherein the source for generating an alternating current is capable of operating at frequencies between approximately 10 kHz and approximately 10 MHz.

13. A device as defined in claim 1, wherein the alternating current electric field is capable of operating at voltages between 100 V and 50,000 V.

14. A device as defined in claim 1, wherein the frequency of the alternating current electric field is greater than the rate of droplets ejected from the cone.

15. A device as defined in claim 1, wherein the increasing frequency of the generated alternating current electric field produces a higher charge state of the analyte.

16. A method of mass spectrometry comprising:

providing at least one emitter;

introducing a fluid into the emitter, the fluid containing an analyte sample;

proving at least one conducting element in electrical communication with the emitter;

introducing an alternating current electric field with a frequency greater than approximately 50 kHz across the emitter;

ionizing the analyte sample;

forming a liquid aerosol drop at a tip of the emitter, the liquid aerosol drop containing the ionized analyte sample and entraining low mobility ions in the liquid aerosol drop;

injecting the liquid aerosol drop into a mass spectrometry device to analyze the liquid aerosol drop to determine the elemental composition of the target sample.

* * * * *